US008900341B2

(12) United States Patent
Dosaj et al.

(10) Patent No.: US 8,900,341 B2
(45) Date of Patent: Dec. 2, 2014

(54) METHOD AND SYSTEM FOR PRODUCING AN ALUMINUM—SILICON ALLOY

(75) Inventors: Vishu Dutt Dosaj, Midland, MI (US); Reinaldo Rodrigues Bittar, Santos Dumont (BR)

(73) Assignee: Dow Corning Corporation, Midland, MI (US)

( * ) Notice: Subject to any disclaimer, the term of this patent is extended or adjusted under 35 U.S.C. 154(b) by 0 days.

(21) Appl. No.: 13/698,960

(22) PCT Filed: May 20, 2011

(86) PCT No.: PCT/US2011/037302

§ 371 (c)(1),
(2), (4) Date: Nov. 19, 2012

(87) PCT Pub. No.: WO2011/146814

PCT Pub. Date: Nov. 24, 2011

(65) Prior Publication Data

US 2013/0055854 A1 Mar. 7, 2013

Related U.S. Application Data

(60) Provisional application No. 61/346,654, filed on May 20, 2010, provisional application No. 61/441,489, filed on Feb. 10, 2011.

(51) Int. Cl.

| | |
|---|---|
| ***C22C 1/02*** | (2006.01) |
| ***F27B 7/00*** | (2006.01) |
| ***C22C 21/02*** | (2006.01) |
| ***C22B 5/04*** | (2006.01) |
| ***F27B 7/06*** | (2006.01) |
| ***F27B 7/20*** | (2006.01) |
| ***F27D 99/00*** | (2010.01) |

(52) U.S. Cl.
CPC . *C22C 21/02* (2013.01); *C22B 5/04* (2013.01); *C22C 1/026* (2013.01); *F27B 7/06* (2013.01); *F27B 7/20* (2013.01); *F27D 99/0033* (2013.01)
USPC ..... 75/684

(58) Field of Classification Search
CPC ..... C22C 1/026; C22C 21/02; C22B 5/04
USPC ..... 75/684
See application file for complete search history.

(56) References Cited

U.S. PATENT DOCUMENTS

| | | | | |
|---|---|---|---|---|
| 2,386,072 A | | 10/1945 | Stewart | 75/503 |
| 3,536,478 A | * | 10/1970 | Ankersen | 75/687 |

(Continued)

FOREIGN PATENT DOCUMENTS

| | | | |
|---|---|---|---|
| CN | 101555013 | 10/2009 | C01B 33/037 |
| DE | 3208878 | 9/1983 | C01B 33/02 |

(Continued)

OTHER PUBLICATIONS

Fedotov, V. M. "WO 1997033008 Method of Obtaining Aluminum—Silicon Alloys." Patentscope. WIPO, Sep. 12, 1997. Web. Mar. 19, 2014. <http://patentscope.wipo.int/search/en/detail.jsf>.*

(Continued)

*Primary Examiner* — George Wyszomierski
*Assistant Examiner* — Tima M McGuthry Banks
(74) *Attorney, Agent, or Firm* — Catherine U. Brown

(57) ABSTRACT

A method and system for producing an aluminum-silicon alloy are provided and include preheating silica to a predetermined temperature and combining aluminum with the preheated silica to melt the aluminum and produce an aluminum-silicon alloy.

9 Claims, 2 Drawing Sheets

(56) References Cited

U.S. PATENT DOCUMENTS

| | | | | |
|---|---|---|---|---|
| 3,704,094 | A | 5/1972 | McClincy et al. | 423/350 |
| 3,704,114 | A | 11/1972 | Wilson et al. | 75/10.5 |
| 3,765,878 | A * | 10/1973 | Bullough | 420/548 |
| 3,868,435 | A | 2/1975 | Daxer | 264/1.21 |
| 3,922,165 | A | 11/1975 | Harker et al. | 75/484 |
| 3,925,296 | A | 12/1975 | Stone et al. | 523/143 |
| 4,247,528 | A | 1/1981 | Dosaj et al. | 117/11 |
| 4,312,848 | A | 1/1982 | Dawless | 423/348 |
| 4,312,849 | A | 1/1982 | Kramer | 423/348 |
| 4,441,920 | A | 4/1984 | Wilkening | 75/10.27 |
| 4,481,031 | A | 11/1984 | Eriksson | 75/10 R |
| 4,497,661 | A | 2/1985 | Valenti | 75/256 |
| 4,539,194 | A | 9/1985 | Halvorsen | 423/348 |
| 5,820,842 | A | 10/1998 | Smith et al. | 423/348 |
| 5,972,107 | A | 10/1999 | Schmid | 117/79 |
| 6,861,040 | B1 | 3/2005 | Ceccaroli et al. | 423/348 |
| 2002/0021996 | A1 | 2/2002 | Clark et al. | 423/348 |
| 2007/0297968 | A1 | 12/2007 | Fukuyama | 423/348 |
| 2008/0233035 | A1 | 9/2008 | Dosaj et al. | 423/348 |
| 2009/0074648 | A1 | 3/2009 | Leblanc et al. | 423/349 |
| 2009/0155158 | A1 | 6/2009 | Ito et al. | 423/349 |
| 2010/0218644 | A1 | 9/2010 | Black et al. | 75/10.59 |
| 2012/0231186 | A1 | 9/2012 | Burns et al. | 428/34.1 |
| 2012/0321541 | A1 | 12/2012 | Dosaj et al. | 423/348 |

FOREIGN PATENT DOCUMENTS

| | | | |
|---|---|---|---|
| DE | 3343406 | 6/1985 | B03B 5/30 |
| DE | 3929635 | 3/1991 | C01B 33/037 |
| EP | 0111584 | 6/1984 | C22C 1/02 |
| GB | 2128635 | 5/1984 | C22C 21/02 |
| JP | 2003-213345 | 7/2003 | C01B 33/037 |
| WO | 98/11018 | 3/1998 | C01B 33/02 |
| WO | 99/10275 | 3/1999 | C01B 33/037 |
| WO | 2006/006487 | 1/2006 | C01B 33/037 |
| WO | 2007/112592 | 10/2007 | C01B 33/037 |
| WO | 2008/110012 | 9/2008 | C01B 33/037 |
| WO | 2009/012583 | 1/2009 | C01B 33/037 |
| WO | 2011/146814 | 11/2011 | C22C 21/02 |

OTHER PUBLICATIONS

Derwent Acc No. 1997-512236 for the patent family including WO 973308 a by Fedotov, V.M. published Sep. 12, 1997. Abstract.*

"Melting Points of Various Metals." Online Metal Store. ThyssenKrupp Materials NA Company, Feb. 4, 2001. Web. Mar. 19, 2014. <http://www.onlinemetals.com/meltpt.cfm>.*

"sand". Encyclopædia Britannica. Encyclopædia Britannica Online. Encyclopædia Britannica Inc., 2014. Web. Mar. 19, 2014 <http://www.britannica.com/EBchecked/topic/521875/sand>.*

Cordoba, F. et al. "Obtaining Silicon by Reduction of $SiO_2$ with Aluminum." Colombian Journal of Chemistry. vol. 13, No. 1, 1984, pp. 83-90 (15 pages).

Kondrashenkov, A. et al. "Conditions for the Aluminothermic Reduction of Silica in Fluid Slags." Chemical and Smelter Slags. 1968, pp. 163-169 (10 pages).

Tuset, J. et al. "Principles of Silicon Refining." Silicon for Chemical Industry. Jun. 1992 (10 pages).

Tuset, J. et al. "Principles of Silicon Refining." International Seminar on Refining and Alloying of Liquid Aluminum and Ferro-Alloys. Trondheim, Norway, Aug. 26-28, 1985 (18 pages).

Cheng, X. et al. "$Al_2O_3$/Al Composites Fabricated by the Reaction of $SiO_2$ Glass Powder with Molten Aluminum in Situ." Special Casting & Nonferrous Alloys, Chinese Mechanical Engineering Society. vol. 133, No. 4, 2003 (3 pages) [Abstract only].

Chirita, G. et al. "Centrifugal Versus Gravity Casting Techniques Over Mechanical Properties." Mechanical Engineering Department; School of Engineering; Minho University, Portugal. 2006 (6 pages).

Dietl, J. et al. "Aluminothermic Reduction of Quartz Sand." Proceedings of the 4th E.C. Photovoltaic Energy Conference. May 1982 (4 pages).

Dietl, J. et al. "New Aspects in Aluminothermic Reduction of $SiO_2$." Proceedings of the 7th E.C. Photovoltaic Energy Conference. Oct. 1986 (5 pages).

Ganesh, R.B. et al. "Directional Solidification of Multicrystalline Silicon Using the Accelerated Crucible Rotation Technique." Crystal Growth & Design, American Chemical Society. vol. 8, No. 7, May 28, 2008 (pp. 2525-2527).

Gorji, Y. M. et al. "Production of Al—Si Master Alloy by Aluminothermic Reduction of Silica in Molten Cryolite." Canadian Metallurgical Quarterly. vol. 46, No. 4, Dec. 2007 (Abstract only).

Hunt, L. P. et al. "Progress on the Dow Corning Process for Solar-Grade Silicon." Journal of Applied Metalworking. Jan. 1, 1979 (pp. 98-105).

Janco, N. "Centrifugal Casting." American Foundry Society. 1988, ISBN10: 0-87433-110-2 (102 pages).

Jun, Z. et al. "Study on Liquid Forming Mechanism for Centrifugal Casting of Solar Cell Silicon Wafer." Working for Materials Science and Engineering Institute of Shanghai University. vol. 19, No. 3, Jul. 1998 (7 pages).

Lu, H. et al. "Producing Aluminum—Silicon Alloys from Andalusite Ore by Carbothermal Reduction Method." Light Metals 2006: Proceedings of the Technical Sessions Presented by the TMS Aluminum Committee at the 135th TMS Annual Meeting, San Antonio, Texas. Mar. 12, 2006 (pp. 512-513).

Maeda, Y. et al. "Large Area Silicon Sheet for Solar Cells." Applied Physics Letters, American Institute of Physics. vol. 41, No. 3, Aug. 1, 1982 (pp. 242-244).

Maeda, Y. et al. "Large-Grain Silicon Sheets by the Improved Spinning Method." Journal of Crystal Growth. vol. 65, 1983 (pp. 331-334).

Maeda, Y. et al. "Large Area Silicon Sheet Produced by the Spinning Method." Proceedings of the 16th IEEE PVSC in San Diego, 1982 (pp. 133-136).

Maeda, Y. et al. "Polycrystalline Silicon Sheets for Solar Cells Produced by Using a Spinning Method." Hoxan Research Laboratory, 1984 (8 pages).

Martinez, G. et al. "Stirring Phenomena in Centrifugal Casting of Pipes." Applied Scientific Research. vol. 44, 1987 (pp. 225-239).

Newman, R. C. "Light Impurities and their Interactions in Silicon." Materials Science and Engineering. vol. B36, 1996 (pp. 1-12).

Prabriputaloong, K. et al. "Reduction of $SiO_2$ in by Molten Al." Journal of the American Ceramic Society. vol. 56, No. 4, Apr. 1973 (pp. 184-185).

"REC Silicon's Technology is Superbly Positioned." Renewable Energy Corporation ASA, 2007 (5 pages).

Rustioni, M. et al. "Advances in Solar Silicon Production." Electrochemical Society Proceedings. vol. 85, No. 9, Jan. 1, 1985 (16 pages).

"Solar Silicon Solution." 6N Silicon Inc. PHOTON San Francisco Conference, Dec. 2, 2008 (15 pages).

International Search Report and Written Opinion mailed Feb. 2, 2012 which issued in corresponding International Patent Application No. PCT/US2011/037302 (14 pages).

* cited by examiner

METHOD AND SYSTEM FOR PRODUCING AN ALUMINUM—SILICON ALLOY

CROSS-REFERENCE TO RELATED APPLICATIONS

This application is a U.S. National Stage of International Application No. PCT/US2011/037302, filed May 20, 2011, which claims the benefit of U.S. Provisional Application No. 61/346,654, filed May 20, 2010, and claims the benefit of U.S. Provisional Application No. 61/441,489, filed Feb. 10, 2011, each of which are hereby incorporated by reference herein in their entireties.

FIELD OF THE INVENTION

The present invention relates to the production of aluminum-silicon alloys and more specifically for producing aluminum-silicon alloys through the aluminothermic reduction of silica.

BACKGROUND OF THE INVENTION

Aluminum-silicon (Al—Si) alloy may be produced by melting aluminum and heating the molten aluminum to above 1200° C. Silica ($SiO_2$) may then be added in the form of quartz fines or sand and mixed into the molten aluminum for 30 to 120 minutes. By superheating the molten aluminum to temperatures greater than 1200° C., the overall temperature of molten aluminum when combined with silica can reach the target reaction temperature of about 1150° C. This heat allows for the reduction of silica with the molten aluminum and results in an aluminum-silicon alloy as well as a by-product slag of silica and aluminum oxide ($Al_2O_3$). The slag, being heavier (i.e., more dense) than the molten aluminum silicon-alloy, separates from the alloy and sinks to the bottom of the molten bath where it is removed. The aluminum-silicon alloy so produced may then be further processed into more purified forms of silicon for use in chemical, solar, or semiconductor applications.

However, for current heating processes such as the use of an induction furnace, in order to achieve the desired temperature for the reaction of silica, the molten aluminum must be excessively heated (i.e., superheated). This results in losses of aluminum as vapor produced by the excessive heating. Furthermore, because silica is less dense than aluminum, the added silica tends to float on top of the molten aluminum, making mixing difficult and inhibiting the overall reaction between the silica and the molten aluminum. Stirring the mixture is difficult because of this tendency of the silica to float and because the high temperature resistant mixing blades, typically fabricated of graphite, are brittle and tend to fail because of the shear stresses generated during mixing. Finally, the by-product slag (typically $Al_2O_3$ and $SiO_2$) has a high melting temperature and the solid slag particles can capture some of the aluminum-silicon alloy as the slag sinks to the bottom of the molten bath. The by-product slag also can adhere to the furnace refractory lining, forming a difficult to remove crust. Because of these inefficiencies in current processes, the utilization of aluminum in reducing silica and forming an aluminum-silicon alloy is only about 50%. That is, only about one-half of the original aluminum alloys with silicon; the remainder is lost as vapor, slag, or captured by separation of the slag. Because aluminum represents a significant portion of the overall cost of the process, there remains a need to provide a more efficient method for producing aluminum-silicon alloys.

SUMMARY

In one embodiment, a method for producing an aluminum-silicon alloy includes preheating silica to a predetermined temperature and combining the preheated silica with aluminum to melt the aluminum and produce the aluminum-silicon alloy. By "predetermined temperature," we mean a temperature which is below the melting point of the silica (approximately 1625° C.), but above the melting point of aluminum (approximately 660° C.) such that when combined, the aluminum will melt and the silica and aluminum are at an appropriate temperature (i.e., above about 1000° C.) for the aluminothermic reaction to take place.

Preferably, silica is provided in the form of particles having an average particle diameter of from about 1.0 to about 5.0 mm, and more preferably from about 2.0 to about 5.0 mm. Generally, particle sizes below about 0.6 mm in diameter are not preferred. The aluminum may also be preheated prior to combining it with the preheated silica or the aluminum may be at ambient temperature. If the aluminum is preheated, preferably it is heated in a furnace to a temperature above its melting point but below about 1200° C. before combining it with the preheated silica. The aluminum can be provided in the form of solid ingots, shots, plates, pellets, or any other suitable form. The aluminum can be in a substantially pure form, or may be in the form of an aluminum-silicon alloy, such as, for example, 80 wt % aluminum and 20 wt % silicon. In one embodiment, the aluminum is coated with silica particles prior to being combined with the preheated silica. For example, silica particles may be formed into a liquid slurry and applied to the surfaces of the aluminum, and the slurry is dried. We have found that pre-coating the aluminum with silica particles protects the aluminum from undue oxidation.

Preferably, once the aluminum has melted, the combined preheated silica and molten aluminum are agitated to encourage mixing. By preheating the silica, the aluminum does not require preheating or superheating. Consequently, less aluminum is lost to oxidation and vaporization during processing, and more aluminum is available to alloy with the silicon.

In another embodiment, a method for producing an aluminum-silicon alloy includes preheating silica in a rotary kiln to a predetermined temperature, adding aluminum to the preheated silica to melt the aluminum, providing an inert atmosphere in the rotary kiln, and agitating the rotary kiln to produce the aluminum-silicon alloy. Preferably, the rotary kiln includes an internal lining comprising an insulating refractory material. Generally, the rotary kiln is rotated at from about 0.1 to about 30 RPM, from about 3 to about 30 RPM, or from about 3 to about 15 RPM.

In yet another embodiment, a system for producing an aluminum-silicon alloy includes a rotary kiln comprising a chamber with a kiln opening adapted to receive a source of heat such as, for example, a burner. The heat source is operable to preheat silica disposed in the rotary kiln, and the rotary kiln preferably includes an inlet to receive aluminum which may be added at ambient temperature or which may be preheated in a furnace to melt it. The rotary kiln includes a rotary drive mechanism for agitating and combining the silica and aluminum to produce the aluminum-silicon alloy.

Generally, the aluminum-silicon alloy that results from practicing embodiments of the invention comprises from about 20 to about 55 wt % silicon and from about 80 to about 45 wt % aluminum. For example, in one embodiment, the resulting aluminum-silicon alloy comprises about 50 wt % silicon and about 50 wt % aluminum.

These and additional features and advantages will be more fully understood from the following detailed description, accompanying drawings, and appended claims.

BRIEF DESCRIPTION OF DRAWINGS

The embodiments set forth in the drawings are illustrative and exemplary in nature and not intended to limit the invention which is defined by the appended claims. The following detailed description of the illustrative embodiments can be understood when read in conjunction with the following drawings in which:

DETAILED DESCRIPTION

Embodiments of the present disclosure provide methods and systems for producing an aluminum-silicon alloy through the aluminothermic reduction of silica. Typically, the aluminum-silicon alloy comprises from about 20 to about 55 wt % silicon and from about 80 to about 45 wt % aluminum. For example, in one embodiment, the resulting aluminum-silicon alloy comprises about 50 wt % silicon and about 50 wt % aluminum. The term aluminum-silicon alloy refers to any aluminum-silicon alloy containing only trace amounts of contaminants such as boron and phosphorous. Trace amounts is defined as less than about 100 parts per million by weight (ppmw). Specifically, embodiments of the present invention provide methods and systems for producing an aluminum-silicon alloy using a rotary kiln, preheated silica, and/or an inert gas atmosphere for the more efficient use of aluminum such that there are fewer losses of aluminum during the process and more aluminum is available to alloy with the silicon.

Furthermore, the by-product slag (generally aluminum oxide) which is produced by the aluminothermic reaction forms as a solid which can be readily removed from the reactor once the molten aluminum-silicon alloy has been tapped and drained off. These methods and systems, taken individually or in combination, improve the overall efficiency of producing an aluminum-silicon alloy and reduce the amount of aluminum lost during processing.

Silica may be reduced by aluminum in an aluminothermic reaction at temperatures above about 900° C. according to the general reaction:

$$4Al+3SiO_2=3Si+2Al_2O_3 \quad \text{(Reaction I)}$$

The silicon produced from the reduction of silica may then be combined with aluminum to produce an aluminum-silicon alloy comprising from about 20 to about 55 wt % silicon and from about 80 to about 45 wt % aluminum. In one embodiment, the aluminum-silicon alloy comprises about 50 wt % aluminum and about 50 wt % silicon.

Figure 1:
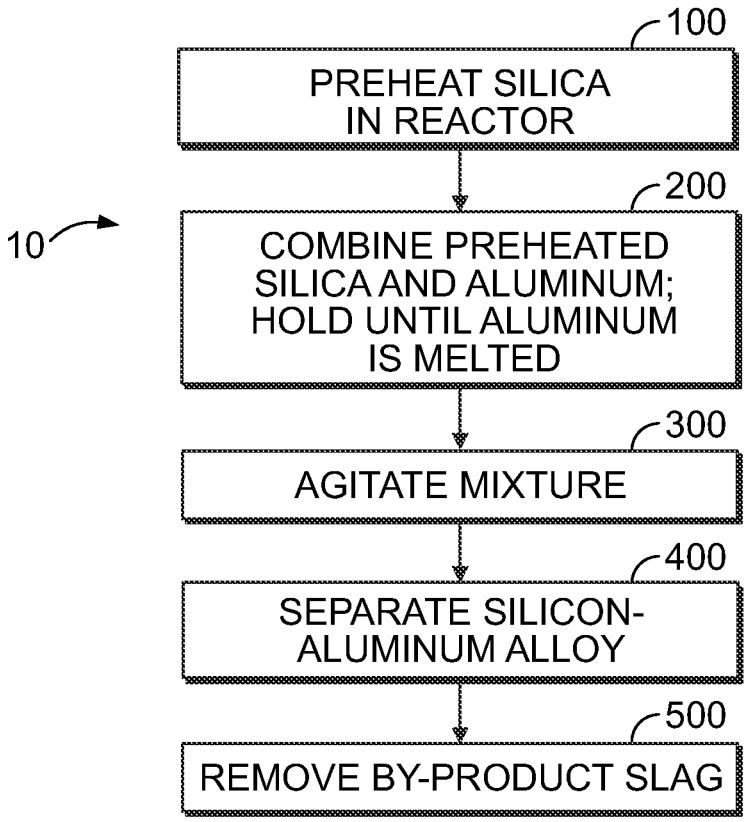
FIG. 1 is a schematic flowchart of an exemplary method for producing an aluminum-silicon alloy according to one or more of the embodiments presented herein.

Referring now to FIG. 1, an exemplary method 10 for producing an aluminum-silicon alloy is shown. The method 10 comprises preheating silica in step 100 to a predetermined temperature. Preferably, the silica is in the form of small particles, typically having an average diameter of from between about 1.0 to about 5.0 mm or from between about 2 to about 5 mm. Silica used in the process can be produced by methods readily known in the art or purchased commercially. The silica may further comprise a variety of physical states or phases of silica. For example, the silica may comprise sand, crushed quartz, quartz fines, fused silica or any other phase or physical state, or any combinations thereof, operable to be preheated and mixed with aluminum to form an aluminum-silicon alloy as described herein.

Aluminum is combined with the preheated silica in step 200 for a time sufficient to melt the aluminum. As described above, the aluminum may be coated with silica particles prior to combining it with the preheated silica. Aluminum may be supplied in any convenient form including ingots, shot, plates, or pellets. The aluminum may be substantially pure, or may be in the form of an aluminum-silicon alloy such as, for example, an alloy containing 80 wt % aluminum and 20 wt % silicon. Once the aluminum has melted, the mixture is preferably agitated in step 300, such as, for example, in a rotary kiln to produce the aluminum-silicon alloy. As described above, the temperature of the silica is such that added aluminum will melt and the aluminothermic reaction will take place. Alternatively, as described above, the aluminum may also be preheated to melt it prior to combination with the preheated silica. Both processes may occur substantially simultaneously such that molten aluminum is produced at about the same time that the silica is preheated. In the alternative, either process may occur before the other so long as the resultant product is maintained in a state applicable for combination. For example, where preheating the silica occurs first, the preheated silica may be stored in an insulated housing to reduce or minimize the amount of heat loss thereby preserving its preheated state. Likewise, where melting the aluminum occurs first, the resultant molten aluminum may be stored in an insulated housing to reduce or minimize the amount of heat loss thereby preserving its molten state.

Preheating the silica in step 100 comprises preheating the silica to a predetermined temperature which will typically be in the range of from about 1000° C. to about 1550° C., from about 1300° C. to about 1400° C., or to about 1300° C. As will be appreciated by those skilled in the art, heating temperatures may vary or fluctuate throughout the method 10. Thus, where it is said that silica is preheated to a temperature of about 1300° C., it should be appreciated that the actual temperature may fluctuate and may not always be held constant at said temperature.

In one embodiment, silica is preheated in a rotary kiln. As illustrated schematically in FIG. 2, the kiln 11 comprises a generally cylindrical shape oriented in a generally horizontal configuration and having an outer wall 12. Lining the interior of outer wall 12 is an insulating refractory material 14. Kiln 11 also includes a kiln opening 16, and a kiln cover 18. For example, in operation, silica 15 is loaded into the kiln via the kiln opening. The kiln opening is further adapted to receive a heat source such as, for example, a burner 20 which may comprise a gas burner fed with a source of gas 22. The burner is used to heat the silica within the kiln to the desired predetermined temperature. Once the predetermined temperature is reached, the burner 20 is removed, and the kiln opening 16 is closed by the kiln cover 18. In one embodiment, solid aluminum at ambient temperature is added through kiln opening 16 after the predetermined temperature has been reached. The insulating refractory 14 may comprise any temperature resistant and insulating material operable to reduce heat loss from the kiln and which does not contaminate the aluminum-silicon alloy product. For example, the refractory may comprise a silica-containing alumina, graphite, silicon carbide or silicon nitride. As shown, rotary kiln 11 is driven by a gear 24 operatively communicating with a drive motor 26.

Figure 2:
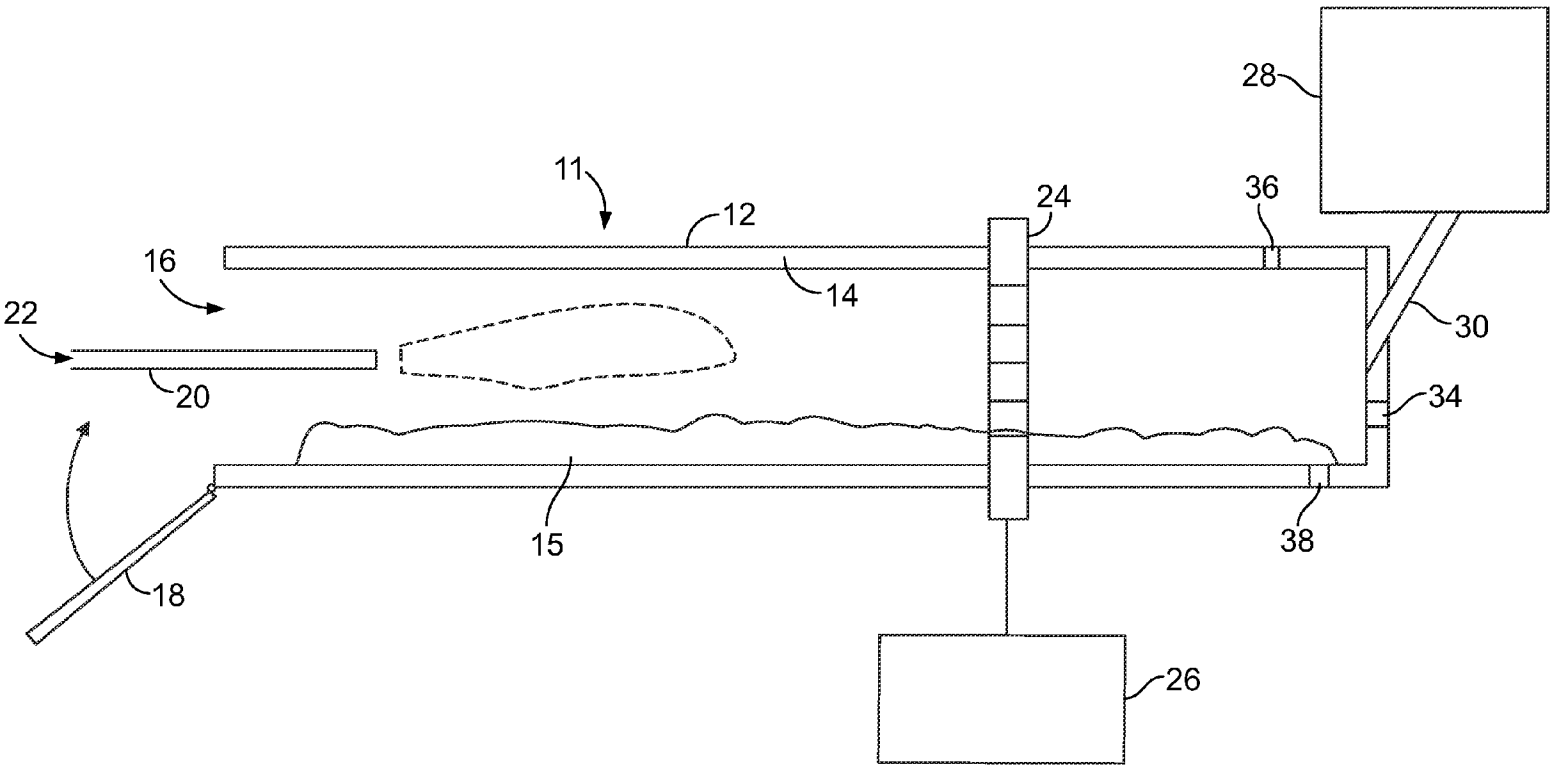
FIG. 2 is a schematic diagram of one embodiment of a system for producing an aluminum-silicon alloy.

Referring both to FIGS. 1 and 2, the method 10 alternatively comprises melting the aluminum to produce molten aluminum prior to combining it with the preheated silica. The aluminum may be contained in a furnace 28 such as, for example, an induction furnace, although other types of furnaces may be used. As discussed above, the melting may occur before, after, or during the preheating of the silica. The aluminum is heated to above its nominal melting temperature of about 660° C., but is not superheated as in the prior art. In one embodiment, this comprises heating the aluminum to a temperature of from about 1000° C. to about 1200° C., from about 1050° C. to about 1150° C., or to about 1100° C. By heating the aluminum to a lower temperature than prior art processes, less aluminum is oxidized and/or vaporized and lost during processing. The lower temperatures which are used retard oxidation of the aluminum. In one embodiment, the aluminum is melted in an induction furnace 28. In another embodiment, any other heating device may be used such as, but not limited to, an electric arc furnace or gas furnace.

In one embodiment, after preheating of the silica and melting of the aluminum to produce molten aluminum, the preheated silica and the molten aluminum are combined, for example, in a reactor such as a rotary kiln. In one embodiment, the reactor comprises the container in which the silica is preheated such that the molten aluminum is directly added to the preheated silica with no transfer of the preheated silica. For example, where the silica is preheated in kiln 11, the molten aluminum is added to the kiln via conduit 30 for the aluminum and silica to mix. Where the kiln comprises a kiln opening 16 as discussed above, the molten aluminum may be added into the kiln via the kiln opening 16 and the kiln opening may subsequently be closed with the kiln cover 18 to reduce heat loss and/or material loss of the preheated silica and molten aluminum.

Furthermore, any suitable method of transport may be used to combine the preheated silica and molten aluminum. In one embodiment, insulated transport devices may be used to transfer the molten aluminum to where the silica was preheated. In another embodiment, channels may be predisposed between a furnace housing the molten aluminum such that the molten aluminum flows from one location to another as induced by gravity and/or the opening and closing of gates. Any other alternative form of repositioning may otherwise be used such that the silica remains preheated and the aluminum remains molten when the two are combined.

The method 10 may further comprise agitating the reactor such as kiln 11, either internally or externally, such as by rotating the chamber in step 300 to encourage mixing of the preheated silica and aluminum. Specifically, agitating the chamber may comprise rotating the chamber while it houses the preheated silica and the aluminum such that the two thoroughly mix with one another. Where aluminum is added as a solid, this agitation increase heat transfer to more quickly melt the aluminum. In one embodiment, the rotation occurs about the horizontal axis of the chamber such that the bottom portion of the chamber, or the portion closest to the floor, rotates toward the top portion of the chamber, or the portion farthest from the floor. In another embodiment (not shown), the reactor may internally comprise a stirrer, such as a graphite stirrer, that moves within the chamber while the reactor rotates to further encourage mixing. In one embodiment, where the silica is preheated in a rotary kiln 11, the reactor may comprise the rotary kiln such that molten aluminum from furnace 28 may be directly added to the rotary kiln to encourage mixing.

The agitation of the reactor in step 300 (such as the rotation of a rotary kiln), may began at any time during the method 10. For example, in one embodiment the reactor may be agitated after the preheating of the silica but before the silica and the aluminum are combined. In another embodiment, the reactor may be agitated after the preheated silica and the aluminum are combined. In yet another embodiment, the reactor may be continuously agitated throughout the entire method 10. In one embodiment, the kiln 11 may be rotated at various speeds which depend on the overall weight of the preheated silica and/or the aluminum and the desired degree of agitation. In one embodiment, the kiln is rotated at speeds of from about 0.1 RPM to about 30 RPM, from about 3 RPM to about 30 RPM, or from about 3 RPM to about 15 RPM. In another embodiment, the kiln's rotation speed may fluctuate throughout the method 10. In yet another embodiment, the kiln may be rotated at any other speed or between any other steps such that the rotation encourages the mixing of the preheated silica and aluminum. The kiln may also be rotated for a time sufficient to mix the preheated silica with the aluminum to cause melting of the aluminum and to produce an aluminum-silicon alloy. In one embodiment, the preheated silica and aluminum are combined and rotated in kiln 11 for from about 10 minutes to about 200 minutes, for from about 20 minutes to about 150 minutes, or from about 30 minutes to about 120 minutes. The time in which the preheated silica and aluminum are mixed depends in part on the overall batch size, the silica preheating temperature, the temperature of the aluminum, the rate of heat loss from the reactor, and/or the degree of agitation in the reactor.

In another embodiment, an inert atmosphere is provided to the reactor to purge the reactor of oxygen. For example, the atmosphere may substantially comprise argon, helium or any combinations thereof, or any other atmosphere that contains little or no oxygen and which does not react with the silica and aluminum. The inert atmosphere may be provided through any available method that allows for the continued mixing of the preheated silica and aluminum within the chamber. In one embodiment illustrated in FIG. 2, the kiln 11 may comprise an inlet port 34 in which an inert gas may be pumped into the chamber. The chamber may further comprise an outlet port 36 that, in combination with the inlet port, allows for the flushing of the kiln atmosphere such that an inert atmosphere is continuously provided. In another embodiment, an inert gas may be pumped into the reactor as the reactor is being sealed such that it is sealed with a substantially inert atmosphere. In yet another embodiment, a porous plug may be disposed in a wall of the reactor and used to inject inert gas. In such an embodiment, the location of the porous plug may have the additional benefit of further encouraging mixing between the preheated silica and aluminum in the reactor. Any other method may alternatively be employed such that the atmosphere within the reactor while the preheated silica and aluminum are mixed contains little or no oxygen. By minimizing the amount of oxygen in the reactor, less aluminum and silicon are lost by oxidation, and the silicon content of the alloy is enhanced.

As a result of the mixing between preheated silica and aluminum, the preheated silica is reduced to silicon in accordance with Reaction I. The silicon is combined with aluminum to form the aluminum-silicon alloy. Along with the aluminum-silicon alloy, a by-product slag is also produced, wherein the by-product slag typically comprises $SiO_2$ and $Al_2O_3$. At the temperatures of operation contemplated by several embodiments of the present invention, the by-product slag remains a solid.

Method 10 also comprises separating the aluminum-silicon alloy from the by-product slag in step 400. Separating the aluminum-silicon alloy may be accomplished in any number of ways. For example, the byproduct slag remains a solid, while the aluminum-silicon alloy is a molten liquid. The reactor may be tilted such that the aluminum-silicon alloy is poured out of the reactor while the by-product slag remains behind. In another embodiment, a tap hole 38 may be provided in the reactor to drain off the molten aluminum-silicon alloy into a casting or the like where the alloys cools and solidifies. In another embodiment, a screen or porous ladle adapted to withstand the temperature of the molten aluminum-silicon alloy may be employed to remove the by-product slag and/or other contaminants from the reactor. Any other alternative process or method for separating out the aluminum-silicon alloy may otherwise be used where such method substantially isolates the aluminum-silicon alloy from the by-product slag and any other additives or particulates.

It should now be appreciated that an aluminum-silicon alloy is produced by preheating silica such that the temperature at which the aluminum is heated is lower than the processes used by the prior art to provide molten aluminum. The lower temperature of the aluminum during melting and processing serves to decrease any oxidative and/or vapor losses of aluminum. Additionally, the reactor utilized in combining the preheated silica and the aluminum may be agitated, such as by rotation, to encourage mixing between the two. In one embodiment, the purging of oxygen by the addition of an inert gas atmosphere further aids in the improvement of the overall efficiency of the alloying process.

It is noted that terms like "specifically," "preferably," "commonly," and "typically" and the like, are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. It is also noted that terms like "substantially" and "about" are utilized herein to represent the inherent degree of uncertainty that may be attributed to any quantitative comparison, value, measurement, or other representation.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

We claim:

1. A method for producing an aluminum-silicon alloy comprising:

preheating silica to a predetermined temperature of from about 1300° C. to about 1400° C.;

combining solid aluminum with the preheated silica to melt the aluminum and produce an aluminum-silicon alloy, wherein the combined preheated silica and aluminum are agitated.

2. A method as claimed in claim 1, wherein the silica is in the form of particles having an average diameter of from about 1 to about 5 mm.

3. A method as claimed in claim 1, wherein the aluminum is preheated to a temperature at or below about 1200° C. before combining with the preheated silica and optionally, wherein the aluminum is melted at a temperature of from about 1000° C. to about 1100° C.

4. A method as claimed in claim 1, wherein the aluminum is an aluminum silicon alloy.

5. A method as claimed in claim 1, wherein the preheated silica and aluminum are combined in a rotary kiln, wherein said rotary kiln optionally includes an internal lining comprising an insulating refractory.

6. A method as claimed in claim 5, wherein said rotary kiln is rotated at from about 0.1 RPM to about 30 RPM.

7. A method as claimed in claim 5, further comprising purging the atmosphere in said rotary kiln with an inert gas, wherein the inert gas optionally comprises argon.

8. A method for producing an aluminum-silicon alloy comprising:

preheating silica to a predetermined temperature;

combining aluminum, wherein the aluminum is in the form of solid ingots, shots, plates or pellets, with the preheated silica to melt the aluminum and produce an aluminum-silicon alloy, wherein the aluminum is coated with silica particles prior to being combined with the preheated silica, and wherein the combined preheated silica and aluminum are agitated.

9. A method as claimed in claim 8, wherein the silica particles are applied to the surface of the aluminum as a liquid slurry and dried.

* * * * *